US006125765A

United States Patent [19]

Loomer

[11] Patent Number: 6,125,765

[45] Date of Patent: Oct. 3, 2000

[54] RAIL INCORPORATING ELEVATION CHANGE AND METHOD FOR ITS PRODUCTION

[75] Inventor: Weston R. Loomer, Walton, Ky.

[73] Assignee: HK Systems, Inc., New Berlin, Wis.

[21] Appl. No.: 09/093,253

[22] Filed: Jun. 8, 1998

[51] Int. Cl.[7] ..... B61B 3/00

[52] U.S. Cl. ..... 104/89; 104/93; 104/106; 104/126

[58] Field of Search ..... 104/126, 124, 104/118, 120, 89, 95, 106, 111, 93; 105/141, 150

[56] References Cited

U.S. PATENT DOCUMENTS

| | | | |
|---|---|---|---|
| 1,115,880 | 11/1914 | Wenzelmann . | |
| 2,197,318 | 4/1940 | Rumble . | |
| 2,862,333 | 12/1958 | Gardiol . | |
| 2,877,506 | 3/1959 | Almoslino . | |
| 2,931,315 | 4/1960 | Daigle . | |
| 3,206,888 | 9/1965 | Litzka . | |
| 4,047,341 | 9/1977 | Bernardi . | |
| 4,073,177 | 2/1978 | Leroux . | |
| 4,146,991 | 4/1979 | Sano . | |
| 5,101,734 | 4/1992 | Sakai | 104/89 |
| 5,150,655 | 9/1992 | Sakai | 104/89 |
| 5,203,733 | 4/1993 | Patch et al. . | |
| 5,687,649 | 11/1997 | Koeninger et al. . | |

*Primary Examiner*—Stephen Avila
*Assistant Examiner*—Lars A. Olson
*Attorney, Agent, or Firm*—Michael Best & Friedrich LLP

[57] ABSTRACT

A pre-fabricated monorail track section (104, 105) can be bent vertically quickly and easily, without using any special tools, so as to effect any of a number of desired incremental inclination changes in the rail section (104, 105) and without plastically deforming the rail section (104, 105). The rail section (104, 105) incorporates one or more slots 242 about which the rail can be bent to effect the desired inclination change. A filler block (248, 306, 314) is positioned in the slot (242) after bending (and possibly during bending under some circumstances) and mounted in place to maintain rail integrity and to permit conveyance devices to travel over the rail section without interference from the slots (242).

25 Claims, 9 Drawing Sheets

RAIL INCORPORATING ELEVATION CHANGE AND METHOD FOR ITS PRODUCTION

BACKGROUND OF THE INVENTION

1. Field of the Invention

The invention relates to rails such as a monorail track and, more particularly, relates to a rail section having a vertical bend to effect an elevation change along the length of the rail section. The invention additionally relates to a method of bending a rail section about its major axis to produce an elevation change in the rail section.

2. Discussion of the Related Art

It is often desirable in article or personnel conveyance applications to effect a change in elevation along the length of a section of a rail. For instance, in a monorail track used, e.g., to support article transportation devices such as a wheeled carrier cell usable in a sortation system, it may be necessary to effect an elevation change within a rail section to permit the article transportation device to move from one operating level to another. It may also be necessary to employ a non-horizontal rail section to accommodate unintended vertical misalignment between track sections. However, it is difficult to bend practically any rail structure so as to effect an elevation change because the rail must be bent along its major axis—a very difficult task. For instance, a monorail track of the type used to support carrier cells or the like is composed of a plurality of interconnected rail sections. Each rail section generally has an I-beam construction including an upper flange or rail and a lower flange or rail connected to one another at their transverse centers by a vertically oriented web which extends colinearly with the major longitudinal axis of the rail. Each rail section is usually formed integrally from a single metal element such as extruded aluminum. Bending a rail section of this configuration (or virtually any other standard configuration) vertically so as to effect an elevation change along the length of the rail section is extremely difficult, particularly in the field where access to special bending tools is limited at best. This is because the entire cross-section of the rail section must be deformed at the location of the bend with one of the flanges being stretched and the other one being compressed. Bending necessarily surpasses the rail section's yield point, resulting in plastic deformation, so that the rail section retains the intended deformation. However, introducing plastic deformation into the rail section effectively renders it impossible to return the rail section to its original, linear configuration. Therefore, a rail section that is bent for a particular purpose usually cannot be bent into a different shape and used for another purpose.

The difficulties associated with bending rail sections have required the exploration of other options to effect vertical change along the length of the rail section. For instance, height changes are effected in extruded aluminum monorail track structures by forming a multi-piece monorail track section by cutting a curved web out of a sheet of track material and by attaching to this curved web pre-bent top and bottom sections having the desired curvature. The resulting three-piece vertical curve assembly effects the desired inclination change but requires the performance of a relatively difficult, time consuming, and expensive process that generally cannot be performed in the field. Hence, the conventional monorail track structure must be laid out very precisely in advance so that elevation changes within the track may be effected via use of vertically curved track sections that are prefabricated to provide a specific elevation or inclination change. This design requirement places considerable limits on the versatility of track design and makes it nearly impossible to effect a "field fix" to accommodate for unanticipated elevation changes in the track layout.

OBJECTS AND SUMMARY OF THE INVENTION

It is therefore a primary object of the invention to provide a versatile, effective, and easy-to implement method of bending a rail section about its major or longitudinal axis to effect an inclination change and resultant elevation change along the longitudinal length of the rail section.

Another object of the invention is to provide a method that meets the first object and that can be performed in the field and without any special tools, thereby permitting a track installer to accommodate unanticipated changes in track elevation.

Still another object of the invention is to provide a method that meets at least the first object of the invention and that does not result in plastic deformation of the rail section, thereby permitting subsequent rebending of the rail section and its use in other applications.

Another object of the invention is to provide a vertically-curved rail section that can be produced quickly, easily, and inexpensively.

Still another object of the invention is to provide a vertically-curved rail section that meets the second principal object of the invention and that can be readily reconfigured to alter the section's inclination change and hence the elevation change occurring along the length of the rail section.

Yet another object of the invention is to provide a rail section that can be readily configured to either extend linearly or to be curved vertically to effect an elevation change and that can be used, either alone or in conjunction with other rail sections, to effect virtually any desired lateral track profile.

Yet another object of the invention is to provide a monorail track assembly having monorail sections meeting at least the second principal object of the invention.

Other objects, features, and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF THE PREFERRED EMBODIMENTS

1. Resume

Pursuant to the invention, a pre-fabricated monorail track section can be bent vertically quickly and easily, without using any special tools, so as to effect any of a number of desired incremental inclination changes in the rail section and without plastically deforming the rail section. The rail section incorporates one or more slots about which the rail can be bent to effect the desired inclination change. A filler block is positioned in the slot after bending (and possibly during bending under some circumstances) and mounted in place to maintain rail integrity and to permit conveyance devices to travel over the rail section without interference from the slots. The rail section can be bent using a conventional wrench simply by turning a cam to drive it against a surface of the rail section. Multiple rail sections can be bent as desired and used in combination with one another and/or with a straight section to effect virtually any elevation change in a rail assembly.

2. Monorail Track System and Carrier Overview

Figure 1:
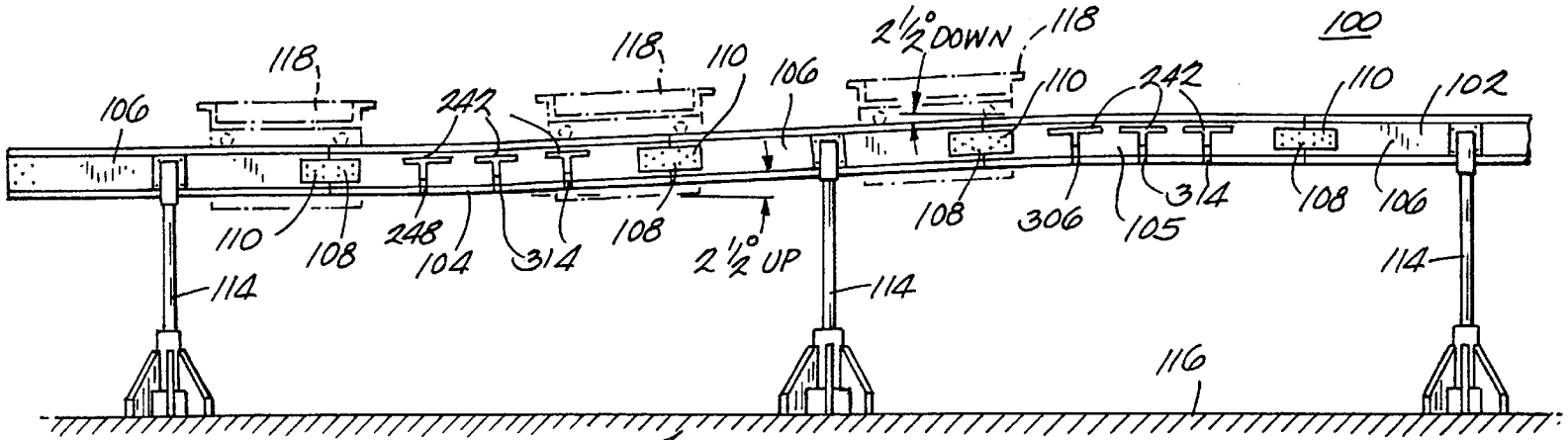
FIG. 1 is a side elevation view illustrating a portion of a monorail sortation system including monorail track sections constructed in accordance with a first preferred embodiment of the invention and carrier cells supported on the monorail track section.
Figure 4:
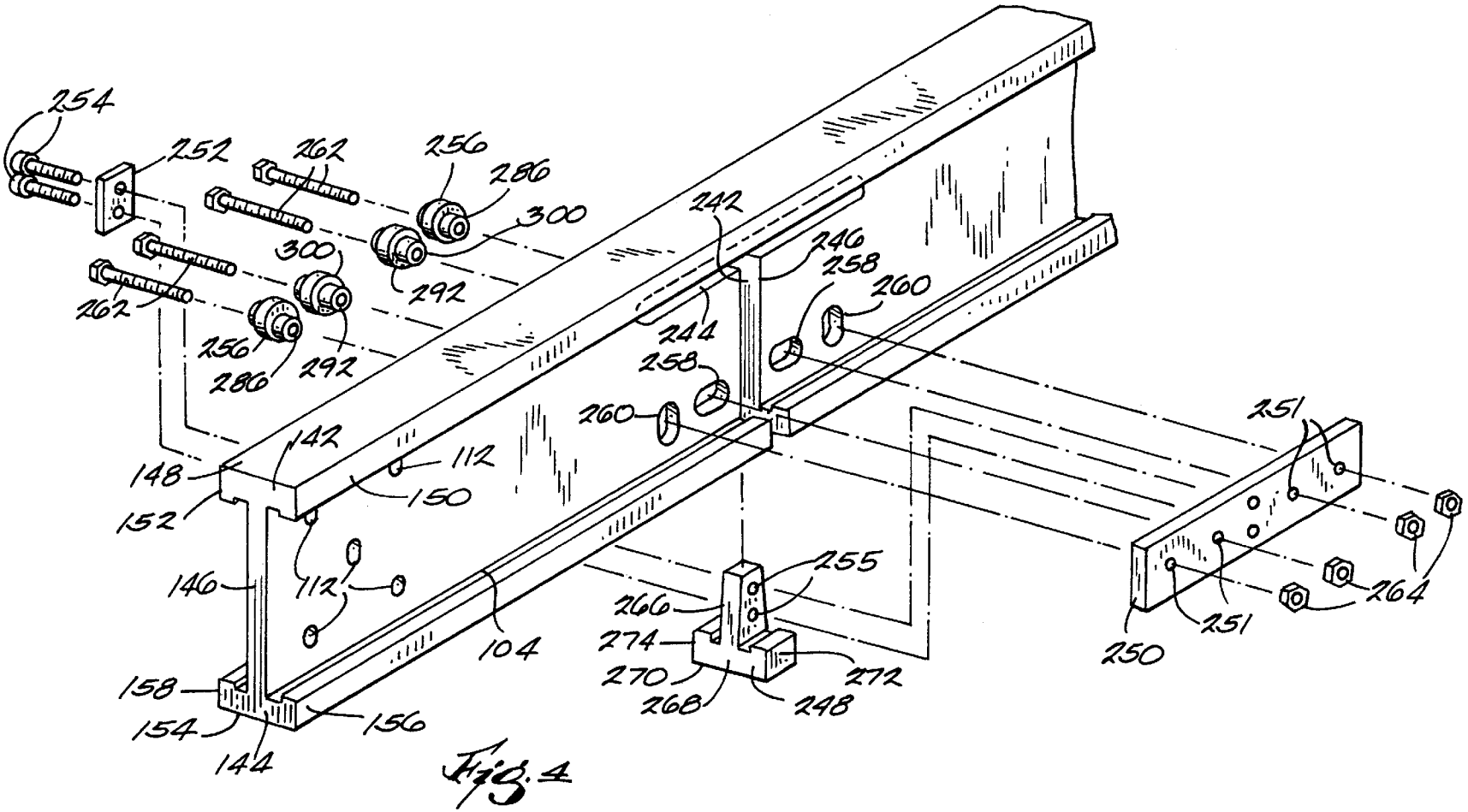
FIG. 4 is an exploded perspective view of a portion of the monorail track section illustrated in FIGS. 2–3.
Figure 5:
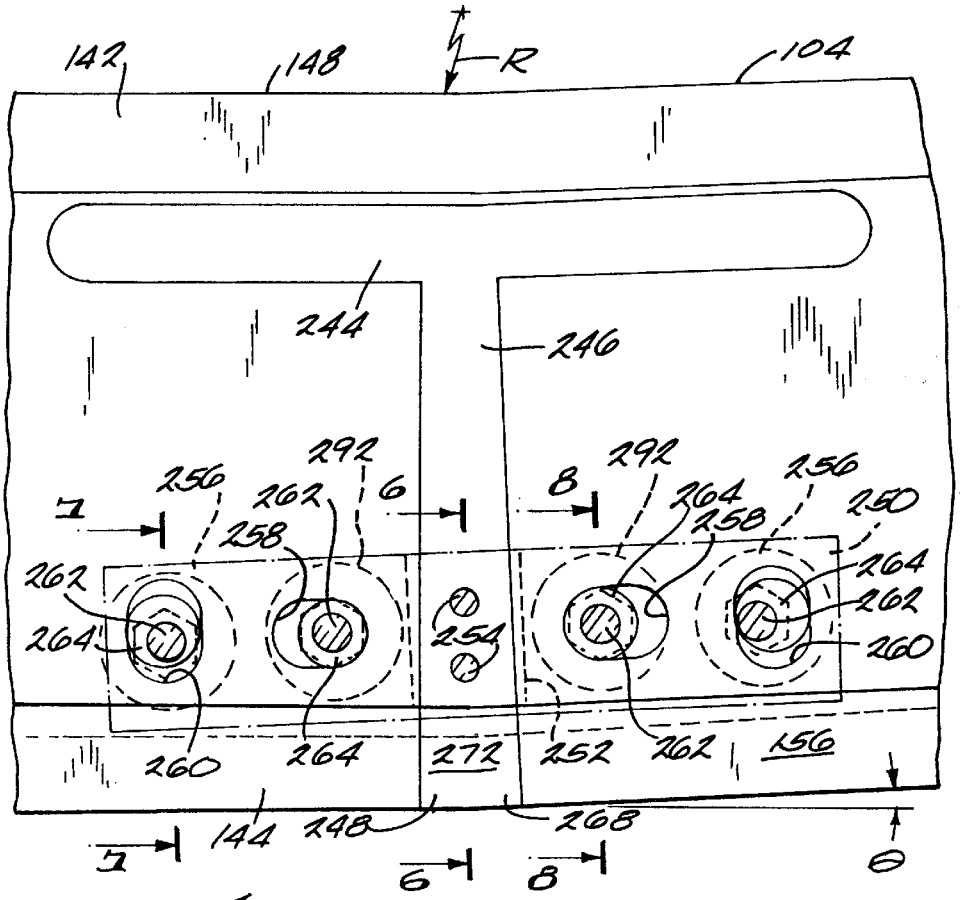
FIG. 5 is a right-side, partially phantom elevation view of the portion of the monorail track section of FIG. 4.
Figure 6:
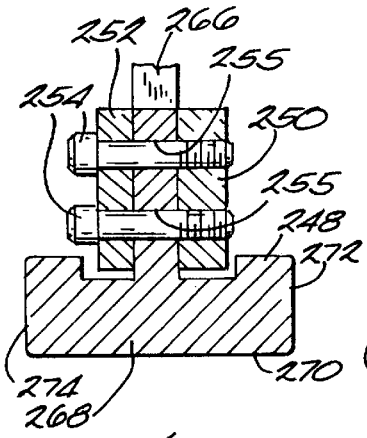
FIGS. 6–8 are sectional end elevation views taken along the lines 6—6, and 7—7, and 8—8 respectively in FIG. 5.
Figure 7:
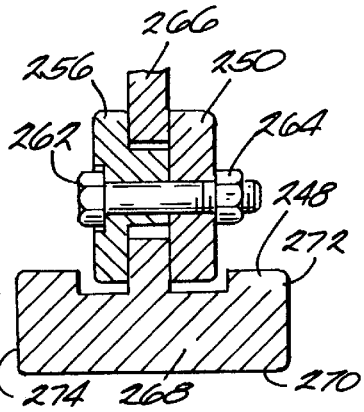
Figure 8:
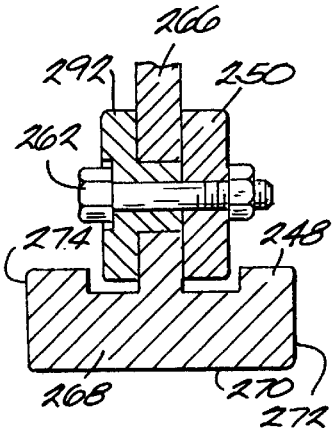

With reference now to the drawings and initially to FIG. 1, a monorail track system 100 incorporates a rail assembly 102 supported above a ground plane 116 by a plurality of track standards 114. Rail assembly 102 is constructed from and includes slotted rail sections 104 and 105 and non-slotted rail sections 106 interconnected by a plurality of joining members 108. Joining members 108 are secured to and join slotted rail sections 104 and 105 and non-slotted rail sections 106 using a plurality of bolts 110 engaging apertures 112 in the rail sections (see, for example, FIG. 4). Slotted rail sections 104 and 105 and non-slotted rail sections 106 are preferably formed by extruding T-6 aluminum to the desired cross-section. Slotted rail sections 104 and 105 are further processed as required to form at least one, and preferably several, T-slots 242 therein as will be discussed in detail below. Joining members 108 could take many forms including simple rectangular plates, but are preferably of the material and construction shown and described in commonly assigned U.S. Pat. No. 5,687,649 the disclosure of which is hereby expressly incorporated herein by reference.

Monorail track system 100 may be adapted for use with any number of trackmounted devices for effecting movement of work-in-process through manufacturing processes, delivery of articles within warehousing and distribution systems, delivery of articles in mail and package sorting and delivery systems, and the like. For purposes of illustration, monorail track system 100 is shown to include a plurality of article carriers 118.

Figure 2:
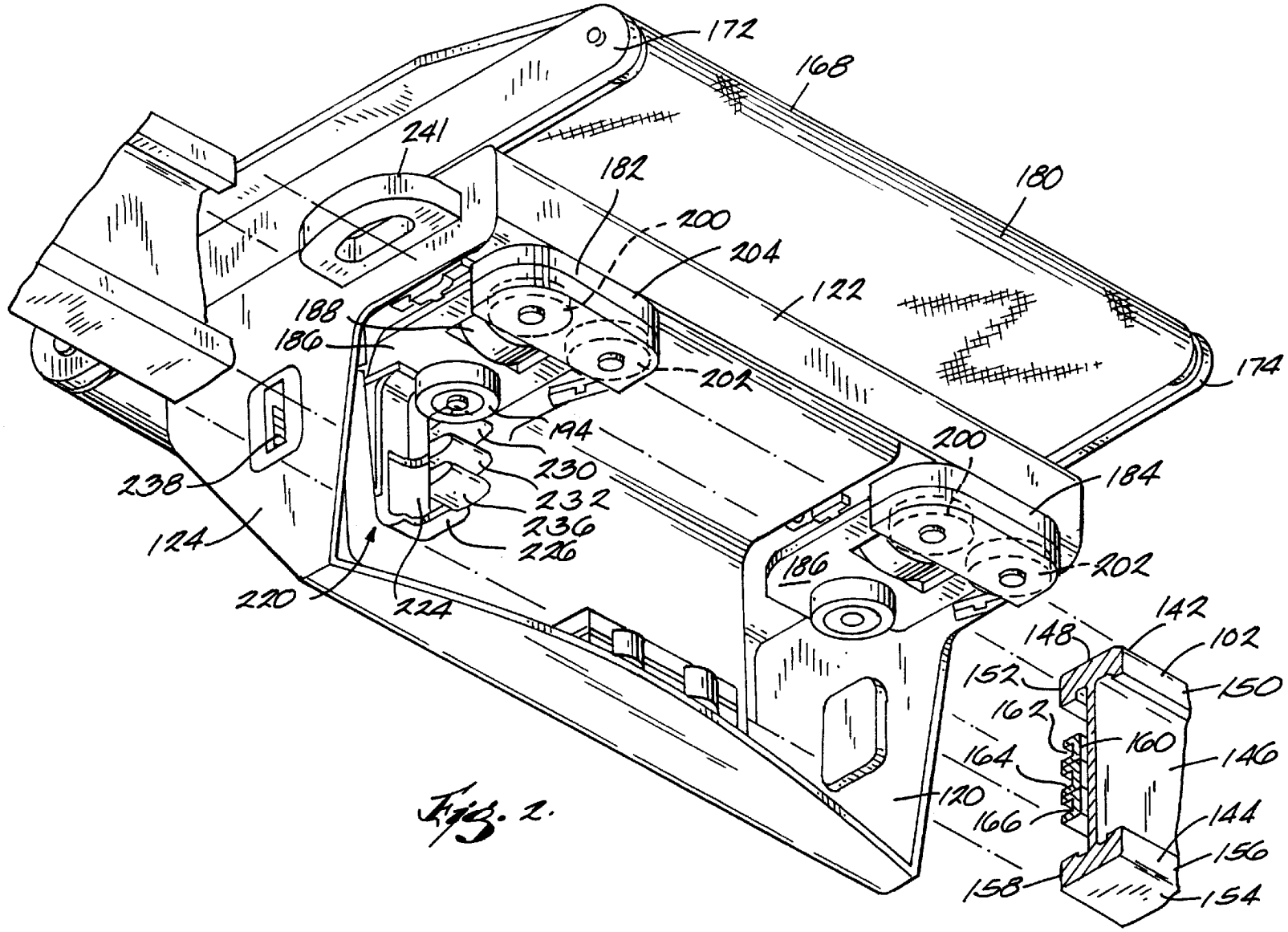
FIG. 2 is a perspective view of one of the carrier cells of FIG. 1 and of a corresponding portion of a monorail track section.
Figure 3:
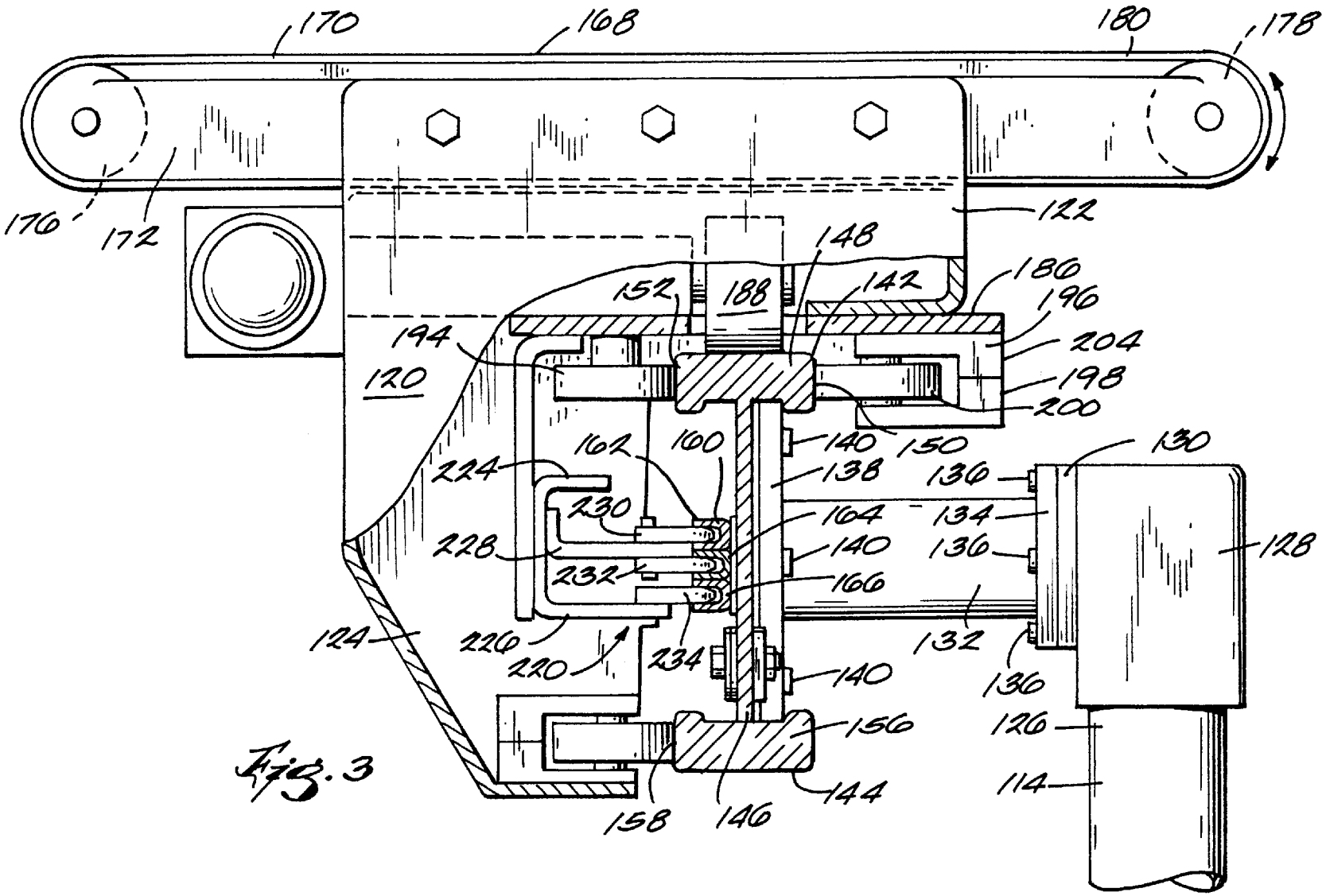
FIG. 3 is a partially cut-away end elevation view of the carrier cell of FIGS. 1 and 2 and of the corresponding portion of the monorail track section.

With reference to FIGS. 2 and 3, the structure of rail assembly 102, and hence each of slotted rail sections 104 and non-slotted rail sections 106, is shown in more detail, as is the engagement of article carriers 118 with rail assembly 102. Track standards 114 support rail assembly 102 above ground plane 116. Each track standard 114 includes a vertical post member 126 supporting an elbow member 128 that has an attaching flange 130 attached to a horizontal extension 132. Horizontal extension 132 includes a mounting flange 134 for securement to attaching flange 130 using suitable threaded fasteners such as screws 136. Horizontal extension 132 also includes rail mounting flange 138 adapted to engage and to secure rail assembly 102 also using threaded fasteners such as screws 140.

Rail assembly 102 includes 1) a vertically-extending web portion 146 extending along the major axis of the rail assembly 102, 2) an upper flange or top head portion 142 extending along the top of the web portion 146, and 3) a lower flange or bottom head portion 144 connected to and extending along the bottom of vertically extending web portion 146. Upper flange portion 142 includes an upper horizontal riding surface 148, an upper inner vertical riding surface 150, and an upper outer vertical riding surface 152 (the terms inner and outer are used simply to distinguish the two vertical riding surfaces and are referenced relative to the track standards; no limitation should be drawn from the designation). Lower flange portion 144 similarly includes a lower horizontal riding surface 154, a lower inner vertical riding surface 156, and a lower outer vertical riding surface 158. In various applications of rail assembly 102, track-engaging devices, such as carriers 118, may engage various combinations of the several riding surfaces as the application dictates. Secured to web portion 146 and extending the length of rail assembly 102 is a bus 160 including conductors 162, 164 and 166 for communicating, for example, power, control and data signals to carriers 118.

With continued reference to FIGS. 2 and 3, each carrier 118 preferably includes a body assembly 120 including an upper horizontal portion 122 and a downwardly extending vertical portion 124. Secured above horizontal portion 122 is an article carrying surface 168 including a substantially horizontal plate member 170 secured between longitudinally-spaced support members 172 and 174. Journally secured at outer ends of horizontal plate member 170 are a driven roller assembly 176 and an idle roller assembly 178 over which a belt 180 is secured for relative motion with respect to horizontal plate member 170 for moving articles onto and from article carrying surface 168.

Each carrier 118 additionally includes a pair of upper wheel assemblies 182 and 184, respectively, secured to horizontal portion 122 of carrier body assembly 120. Each upper wheel assembly 182 and 184 include 1) a horizontal wheel member 188 journally supported and adapted to engage upper horizontal riding surface 148, and 2) an inner vertical wheel assembly 204 and outer vertical wheel assembly 194 adapted to engage upper inner vertical riding surface 150 and upper outer vertical riding surface 152, respectively. More particularly, each upper wheel assembly 182 and 184 includes a horizontal support member 186 to which outer vertical wheel assembly 194 is journally mounted. Inner vertical wheel assembly 204, including wheel mounting block 196 and wheel mounting block 198, is also secured to support member 186 and journally supports a first inner vertical wheel 200 and a second inner vertical wheel 202. A gearmotor (not shown) is secured to vertical portion 122 of body assembly 120 and provides driving torque via a transmission to horizontal wheel 188 of upper wheel assembly 182 for moving carrier 118 relative to rail assembly 102.

The gearmotor receives electrical power and control signals via a signal interface assembly 220. Interface assembly 220 includes mounting assembly 224 having a channel section shape. Mounting assembly 224 includes 1) a horizontal mounting flange 226 formed integral thereto and 2) a second horizontal mounting flange 228 secured thereto. First and second signal contactors 230 and 232 are secured to horizontal mounting flange 228, and a third signal contactor 234 is secured to mounting flange 226 and positioned to respectively engage the power and control signal conductors 162, 164 and 166 of power and control bus 160. Each carrier 118 further includes a data interface connector 238 for coupling several carriers together and for coupling the carriers to a system controller (not shown). For manually manipulating the position of carrier 118 along rail assembly 102, a handle 241 is provided and secured to horizontal portion 122 of body assembly 120. Handle 241 is constructed from a resilient material and also serves as a bumper between carriers.

3. The Slotted Rail Sections

Figure 16:
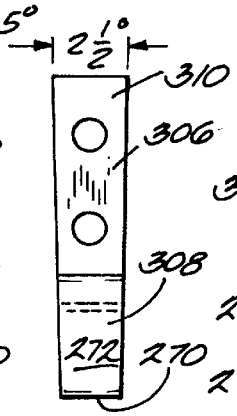
FIG. 16 is a side elevation view of a decline filler block usable in the monorail track section of FIGS. 2 and 3.
Figure 17:
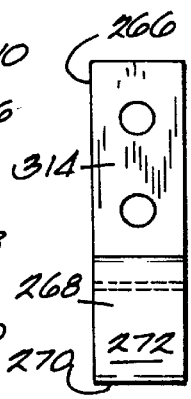
FIG. 17 is a side elevation view of a straight or no-incline filler block usable in the monorail track section of FIGS. 2 and 3.

With reference now to FIGS. 4–11, a portion of a slotted rail section 104 is shown configured to provide vertical curvature in accordance with a preferred embodiment of the present invention. Slotted rail section 104 is formed with at least one T-slot 242 in web portion 146 designed to receive a T-shaped filler member 248, 306 (FIG. 16), or 314 (FIG. 17). T-slot 242 includes 1) a horizontal slot portion 244 formed below and substantially adjacent upper flange 142 and 2) a vertical slot portion 246 bisecting horizontal slot portion 244 and extending downwardly therefrom and through lower flange 144. Preferably, the width of both horizontal slot portion 244 and vertical slot portion 246 is substantially the same advantageously permitting machining of slots using a single milling cutter. Most preferably, slot 244 is approximately 8.0" in length, and slots 244 and 246 are approximately 0.75" in width. A convoluted edge milling cutter is preferably used to form them. Formed symmetrically about vertical slot 246 in web portion 146 and closely adjacent lower flange 144 are horizontal cam slots 258 and vertical cam slots 260. The width of horizontal cam slots 258 and vertical cam slots 260 is also preferably substantially the same as the width of horizontal slot portion 244 and vertical slot portion 246 for allowing use of the same milling cutter for forming these slots as well. As will be appreciated, horizontal cam slots 258 and vertical cam slots 260 are formed by first making a plunge cut and then milling the remaining material to form the desired slots. In this regard, the preferred convoluted edge milling cutter includes flutes extending to the end of the cutter shaft so that it may come vertically down onto the surface making the requisite plunge cut.

Filler member 248 is positioned within a lower portion of vertical slot 246 adjacent lower flange 144. Filler member 248 is retained within vertical slot 246 and between a tie plate 250 and a keeper plate 252, which are positioned on opposite sides of web portion 146 by screws 254 engaged through apertures 255. Tie plate 250 extends longitudinally along web portion 146 about either side of vertical slot 246 and includes apertures 251, which respectively substantially align with centerlines of horizontal cam slots 258 and vertical cam slots 260. Eccentric cams 256 are received within vertical cam slots 260. Concentric cams 292 are received within horizontal cam slots 258. Eccentric cams 256 and concentric cams 292 are formed with threaded through-apertures 286 and 300, respectively. Bolts 262 are threaded through apertures 286 and 300, pass through apertures in tie plate 250, and are retained by nuts 264 disposed outboard of the tie plate 250. As will be described, filler member 248, tie plate 250 and keeper plate 252 cooperate to retain the desired vertical curvature of slotted rail section 104 and to substantially return the structural integrity lost as a result of forming T-slots 242. It will be appreciated that keeper plate 252 may not be required in every application, but will in certain applications provide further support and resistance to bending of filler member 248.

Figure 15:
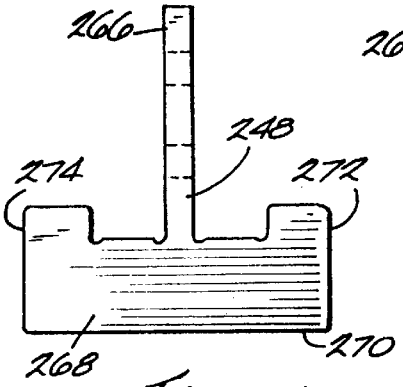
FIG. 15 is an end side elevation view of a filler block of FIG. 14.
Figure 14:
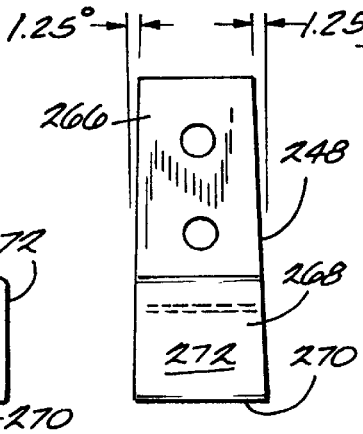
FIG. 14 is a side elevation view of an incline filler block usable in the monorail track section of FIGS. 2 and 3.

As shown in FIGS. 4–11, vertical slot 246, while initially being formed with a substantially uniform width, is opened at a bottom portion forming a tapered slot narrowing from a widest portion at lower flange 144 to a narrowest portion at horizontal slot 244. Deformation of slotted rail 104 by causing a widening of vertical slot 246 creates the desired upward vertical curvature in upper horizontal riding surface 148. In the preferred embodiment shown in FIGS. 4–11, filler member 248 has a tapered configuration substantially matching the taper introduced to vertical slot 246. More particularly, and with reference to FIGS. 14 and 15, filler member 248 is formed with a web portion 266 and a lower flange portion 268 having substantially the same cross-sectional configuration as a lower portion of slotted rail 104.

Thus, filler member 248 includes a horizontal riding surface 270, an inner vertical riding surface 272, and an outer vertical riding surface 274. When installed into slot 246, surfaces 270, 272 and 274 substantially align to surfaces 154, 156 and 158, respectively, of slotted rail member 104 to provide substantially continuous riding surfaces. Most preferably, and advantageously, filler member 248 is formed by cutting a section from an extruded rail member, removing the upper flange and machining the appropriate taper.

Figure 18:
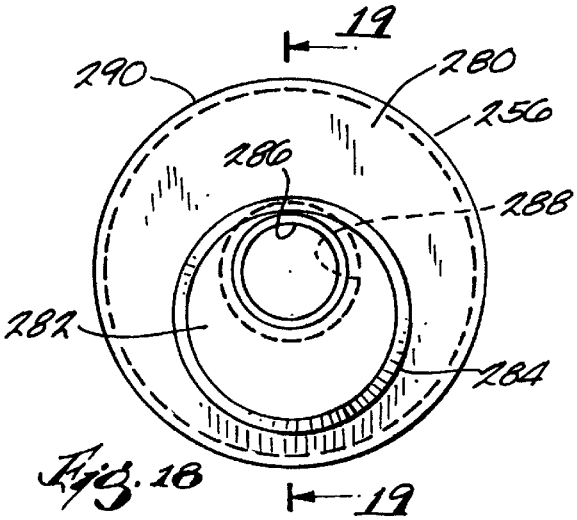
FIG. 18 is an end elevation view of a cam of an eccentric cam bolt assembly of the portion of the monorail track section illustrated in FIGS. 4–11.
Figure 19:
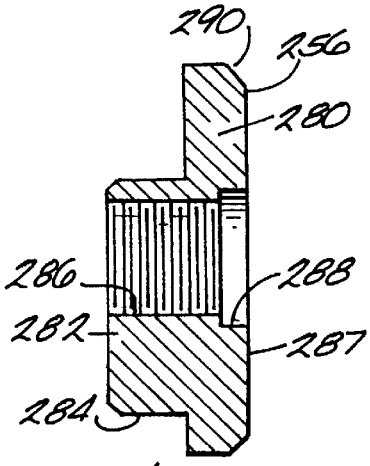
FIG. 19 is a sectional view taken along the lines 19–19 in FIG. 18.

Interaction of eccentric cams 256 with vertical cam slots 260 and tie plate 250 impart the desired deformation to slotted rail 104. With continued reference to FIGS. 4–11 and further reference to FIGS. 18 and 19, eccentric cams 256 are formed to include a circular flange 280 having a flat surface 287 and an annular camming portion 282. Annular camming portion 282 is eccentrically offset from the centerline of circular flange 280 and includes a camming surface 284. A threaded through aperture 286 is formed along the centerline of circular flange 280 and includes a recess portion 288. A chamfer 290 is also provided on flange 280. A bolt 262 is threaded through aperture 286 until the head thereof engages flat surface 287, thus causing concomitant turning of eccentric cam 256 with bolt 262. It will be appreciated that cam bolts having the aforementioned configuration may be substituted for the eccentric cam/bolt assembly described without departing from the fair scope of the present invention. It should also be noted that recessed portion 288 is provided to allow clearance for an unformed thread portion of bolt 262 adjacent the head. Rotation of one or both eccentric cams 256 received within vertical slots 260 causes camming surfaces 284 to bear against the walls of vertical cam slots 260 and to introduce a linear force along tie plate 250. In the example shown in FIGS. 4–11, eccentric cams 256 are positioned within vertical slots 260 such that clockwise rotation of bolts 262, and hence eccentric cams 256, will cause camming surfaces 284 to bear against the outside surfaces of vertical slots 260, i.e., the vertical surfaces of the slots 260 located nearest T-slot 242. The force generated in this manner produces a compression force in tie plate 250, and likewise, interaction of tie plate 250 with slotted rail section 104 wrenches open vertical slot 260 forming the aforementioned tapered configuration. Once opened in this manner, filler member 248 may be inserted into and secured within vertical slot 260 to retain the tapered configuration. The force necessary to cause the vertical curvature in slotted rail section 104 is easily generated using a hand wrench on bolts 262 to effect the turning. In this manner, and in accordance with the present invention, vertical curvature may be introduced into slotted rail section 104 without the use of special tools or equipment.

Figure 20:
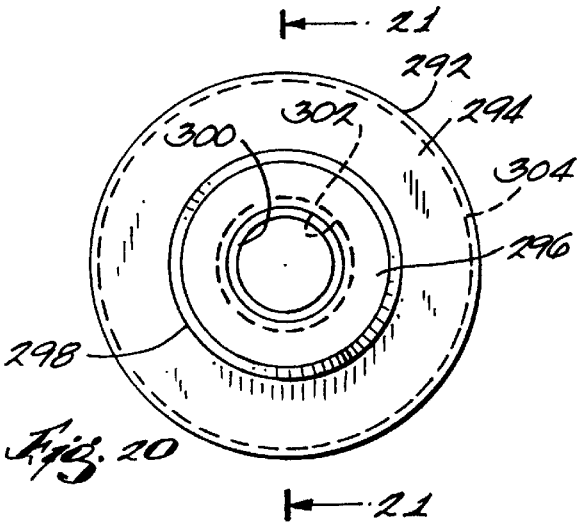
FIG. 20 is an end elevation view of a cam of a concentric cam bolt assembly of the portion of the monorail track section illustrated in FIGS. 4–11.
Figure 21:
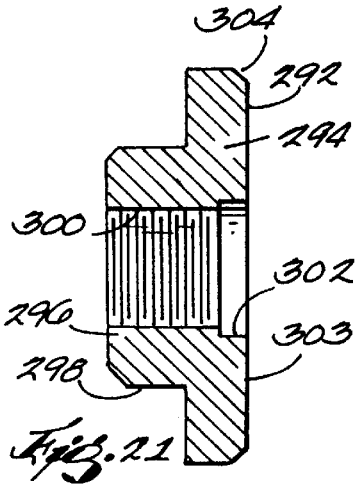
FIG. 21 is a sectional view taken along the lines 21–21 in FIG. 20.

Tie plate 250 may be formed form either steel or aluminum, and eccentric cams 256 are preferably formed from steel, which may be hardened. Similarly concentric cams 292 are formed from steel. With reference to FIGS. 20 and 21, concentric cams 292 include a include a circular flange 294, flat surface 303 and an annular camming portion 296 concentrically aligned with the centerline of circular flange 294 and including a camming surface 298. A threaded through aperture 300 is formed along the centerline of circular flange 294 and includes a recess portion 302. A chamfer 304 is also provided on flange 294. A bolt 262 is threaded through apertures 300 until the head thereof engages flat surface 303. Again, it will be appreciated that cam bolts having the aforementioned configuration may be substituted for the eccentric cam/bolt assembly described without departing from the fair scope of the present invention. Concentric cams 292 are received in horizontal cam slots 258 with bolts 262 extending through apertures 251 formed in tie plate 250. Bolts 262, and hence concentric cams 292, are secured to slotted rail section 104 and tie plate 250 with nuts 264. Concentric cams 292 interact with the upper and lower surfaces of horizontal cam slots 258 to limit vertical movement of tie plate 250 relative to slotted rail section 104 while permitting longitudinal movement of concentric cams 292 and tie plate 250 necessary for effecting the desired deformation. In a completed assembly, concentric cams 292 including bolts 262 and nuts 264 contribute to the structural support of slotted rail section 104 and to maintaining the desired vertical curvature.

Horizontal slot portion 244 is provided to distribute the vertical curvature, and hence deformation, of horizontal riding surface 148 over a larger length of slotted rail section 104. Without horizontal slot portion 244, plastic deformation of horizontal riding surface 148 would occur in a localized area near the end of vertical slot portion 246. This local distortion in the track surface is unacceptable in certain applications. Similar localized distortion may be introduced through the use of "L" configured slots, and hence, it is preferred to use the T-slot configuration. Horizontal slot portion 244 allows for the deformation necessary to form the desired vertical curvature to be spread substantially over its length thereby providing a smooth transition in horizontal riding surface 148.

Figure 12:
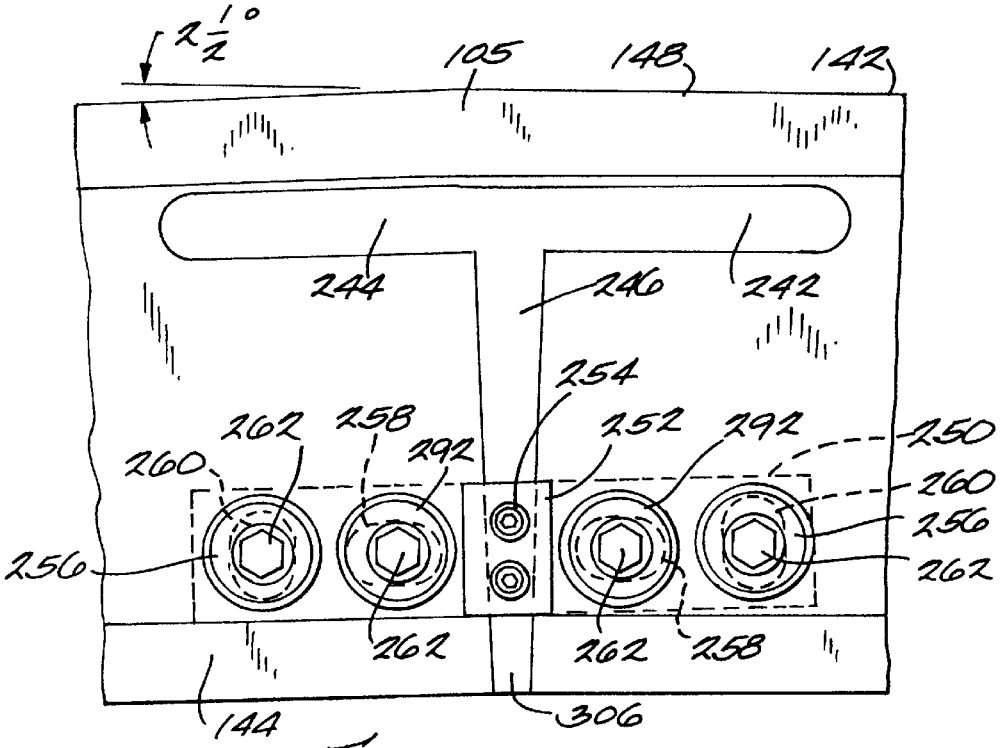
FIG. 12 is a side elevation view of the portion of the monorail track section of FIGS. 4–11, illustrating the track section in conjunction with a decline filler block.
Figure 13:
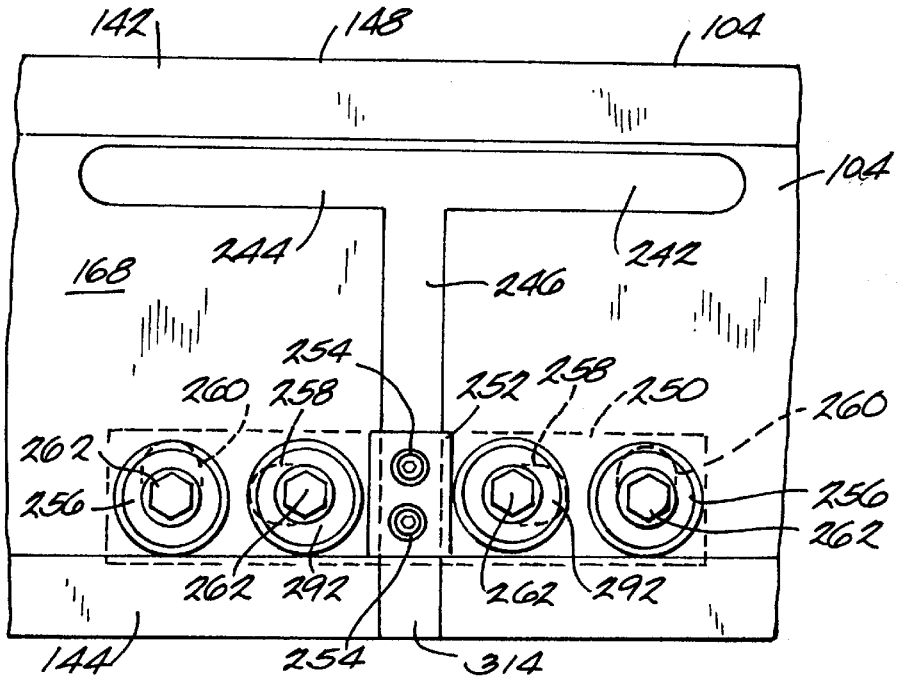
FIG. 13 is a side elevation view of the portion of the monorail track section of FIGS. 4–11, illustrating the track section in conjunction with a straight or no-incline filler block.

It should be appreciated that in introducing vertical curvature to slotted rail section 104, the aluminum material forming slotted rail section 104 is not deformed beyond its elastic limit. In this regard, slotted rail section 104 may be returned substantially to its original configuration by removing the force introduced through eccentric cams 256 and tie plate 250. Thus, slotted rail section 104 may be easily reconfigured as the application requires. Moreover, slotted rail section 104 may be configured to provide both descending as well as ascending elevation changes. So far it has been discussed to introduce a taper to vertical slot portion 246 narrowing from a widest opening at lower flange 144 to a narrowest opening at upper flange 142. Such a configuration, as shown in FIGS. 4–11 for slotted rail section 104, introduces an ascending vertical curvature to slotted rail section 104. Referring then to FIG. 12, a portion of slotted rail section 105 configured to introduce a descending vertical curvature is shown. In all aspects in an undeformed state slotted rail sections 104 and 105 are identical to one another. By positioning eccentric cams 256 in vertical cam slots 260 such that clockwise rotation of bolts 262 cause camming surfaces 264 to bear against the inner walls, i.e., the walls nearest from T-slot 242, a tension force is introduced in tie plate 250. The tension force causes an elastic deformation in slotted rail section 105. In this case, however, vertical slot portion 246 tends to narrow at lower flange 144. Hence, a taper, expanding from a narrowest portion at lower flange 144 to a widest portion at upper flange 142 is introduced in vertical slot portion 246. A filler member 306 (as seen in FIG. 16) is formed similar to filler member 248 including a bottom flange 308 and a web portion 310. Filler member 306 differs in that the taper widens from a narrowest portion at bottom flange 308 to a widest portion at web 310 substantially matching the taper of vertical slot portion 246. Filler member 306 is secured within vertical slot portion 246 as described using tie plate 250 and keeper plate 252. In this manner, a descending vertical curvature is introduced into slotted rails section 105 as shown in FIG. 12.

Figure 22:
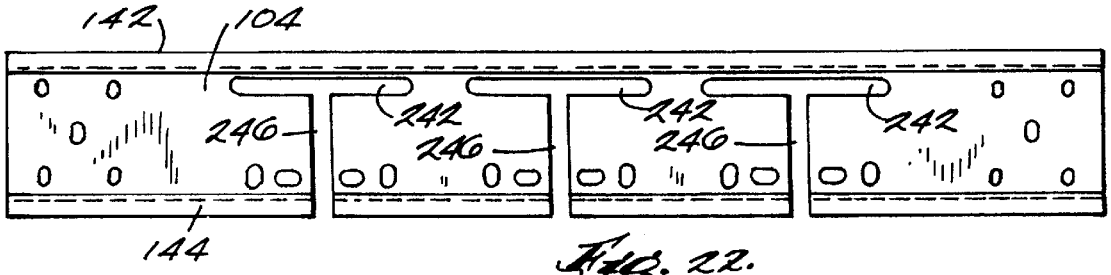
FIG. 22 is a side elevation view of the monorail track section of FIGS. 2 and 3 constructed in accordance with a preferred embodiment of the present invention.
Figure 23:
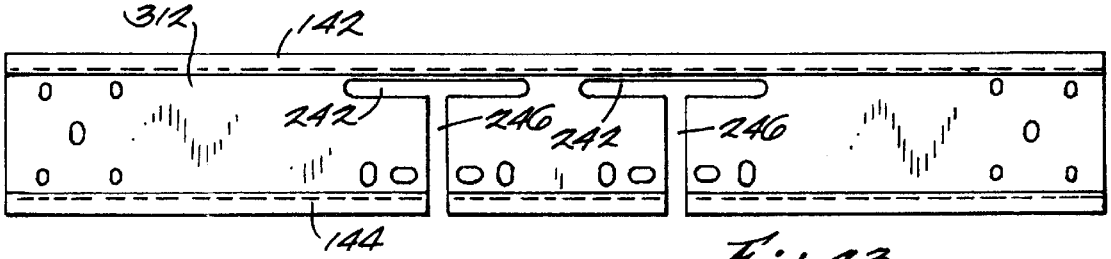
FIG. 23 is a side elevation view of a monorail track section constructed in accordance with another embodiment of the invention.
Figure 9:
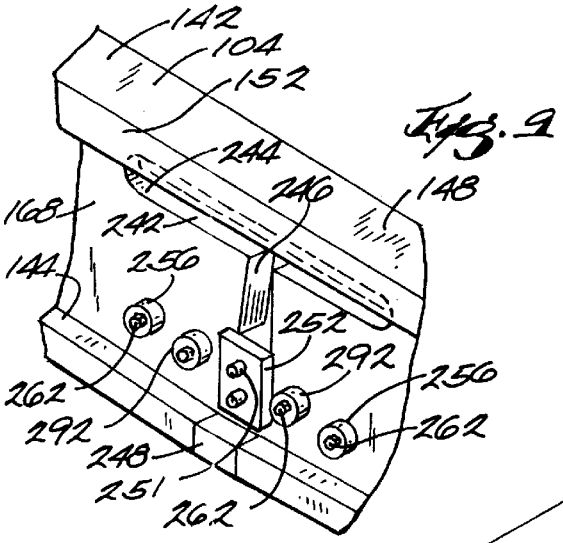
FIGS. 9 and 10 are perspective views of the portion of the monorail track section illustrated in FIGS. 5–8, seen from the left and right sides of the monorail track section, respectively.
Figure 10:
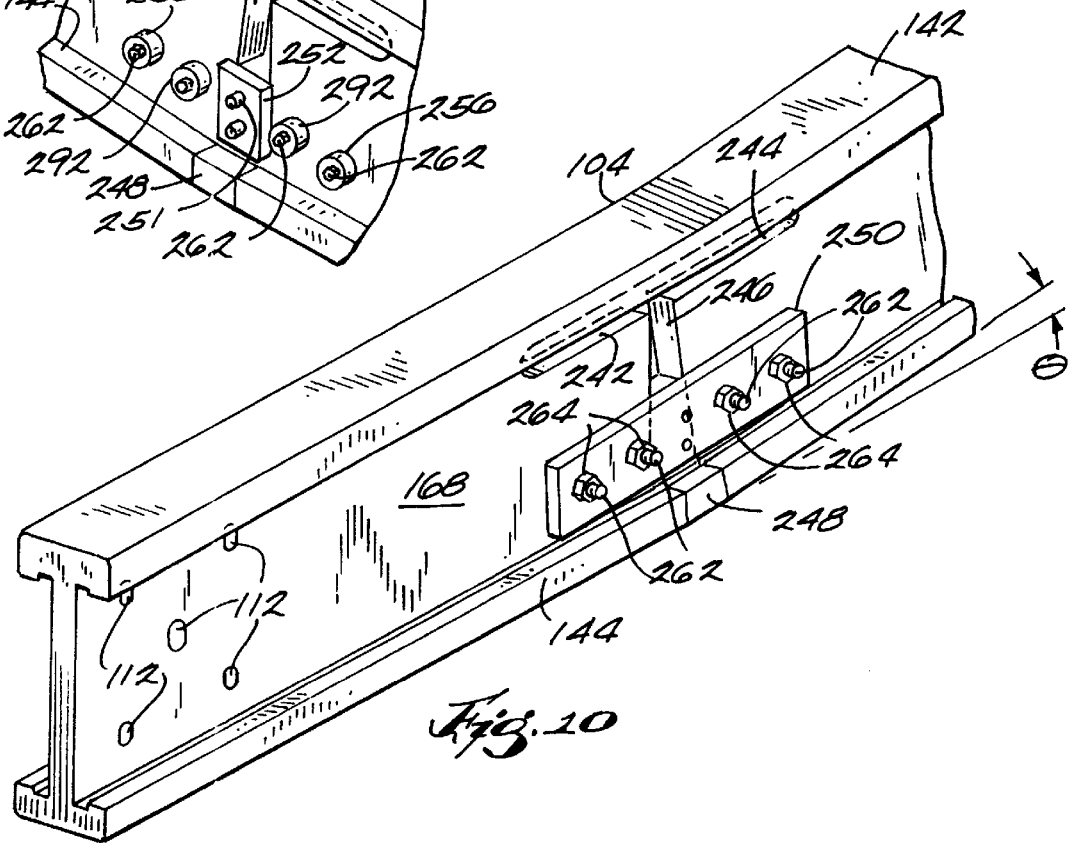
Figure 11:
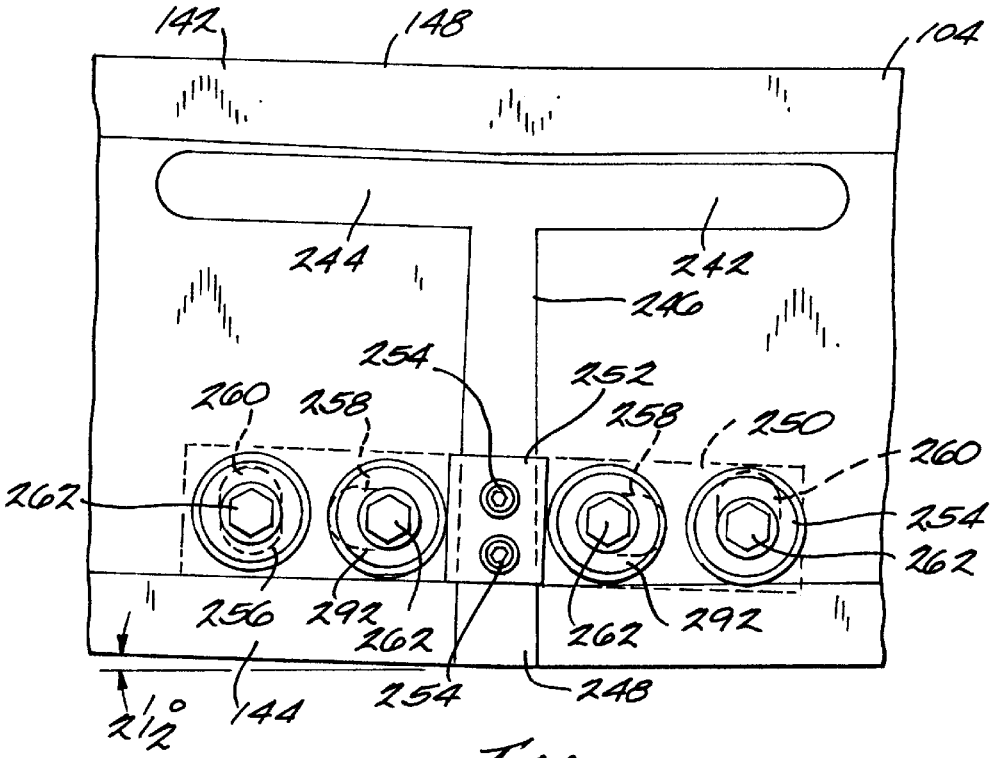
FIG. 11 is a left-side elevation view of the portion of the monorail track section illustrated in FIG. 5.

To limit localized distortion of horizontal riding surface 148 for applications requiring vertical curvature in excess of, for example, 2–3 degrees elevation, it is preferred to introduce the vertical curvature incrementally. Slotted rail section 104 is shown throughout and particularly in FIG. 22 to include three T-slots 242. It will be appreciated that one, two, three or more T-slots may be used and, for example, a two T-slot 242 rail section 312 is shown in FIG. 23. It is preferred to maintain the maximum incremental change in vertical curvature at any one T-slot at about 2 ½°. Not only does this guard against overly-distorting horizontal riding surface 148, but it also allows for standardizing filler members 248 and 306. Various elevation changes may be introduced by providing vertical curvature in slotted rail sections 104 and extending these elevation changes over a run constructed from non-curved slotted rail sections 104, or more preferably, from non-slotted rail sections 106. If a more rapid increase in elevation is required, multiple T-slots may be configured to provide, preferably in increments of 2½°, additional vertical curvature. This feature of the present invention is illustrated in FIGS. 1 and 24–27.

Figure 27:
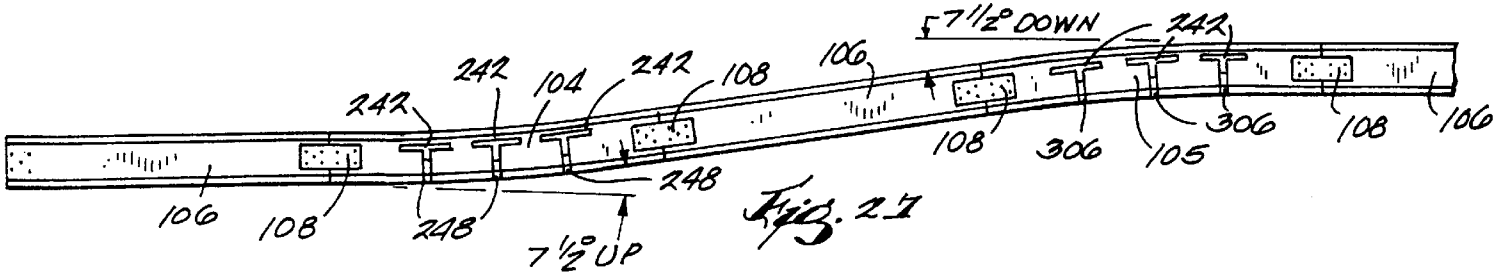
FIG. 27 is a side elevation view illustrating the monorail track section as configured in FIG. 26, used in conjunction with a straight monorail track section and a monorail track section having an equal and opposite vertical curvature.
Figure 25:
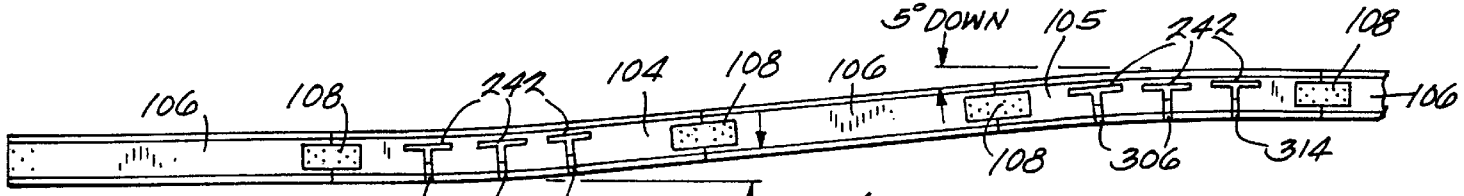
FIG. 25 is a side elevation view of the monorail track section as configured in FIG. 24, used in conjunction with a straight monorail track section and a monorail track section having an equal and opposite vertical curvature.
Figure 24:
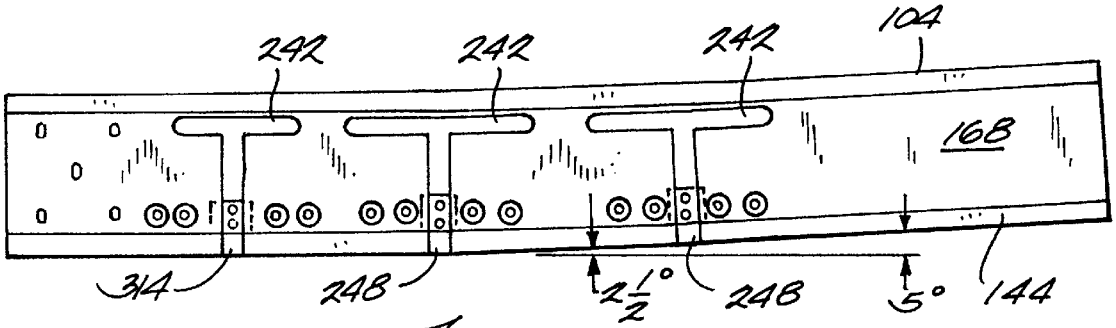
FIG. 24 illustrates the monorail track section of FIGS. 2 and 3 configured to effect a 5° aggregate inclination change along its longitudinal length.
Figure 26:
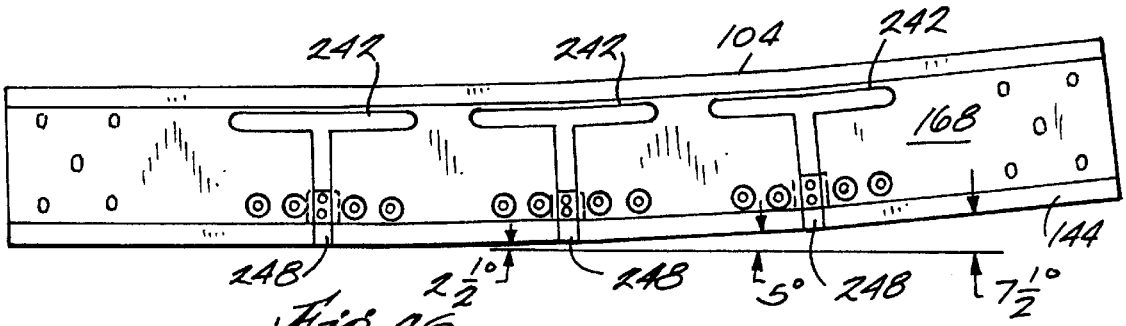
FIG. 26 is a side elevation of the monorail track section of FIGS. 2 and 3 configured to effect a 7½° aggregate inclination change along its longitudinal length.

Referring once again to FIG. 1 and to FIGS. 24–27, in FIG. 1 a single T-slot 242 is configured to provide, respectively, a 2½° ascending vertical curvature in slotted rail section 104 and a 2½° descending vertical curvature in slotted rail sections 105. This 2½° inclination is extended over a non-slotted rail section 106 to provide a net elevation to rail assembly 102. As seen in FIGS. 24 and 25, a two T-slots 242 in each of slotted rail sections 104 and 105 are configured to provide, respectively, a net 5° ascending vertical curvature (2½° by 2 T-slots) and a net 5° descending vertical curvature. The vertical inclination is extended over non-slotted rail section 106 to provide a net elevation to rail assembly 102, greater than that shown in FIG. 1. As best seen in FIG. 24, the remaining T-slot 242 in each of slotted rail section 104 and slotted rail section 105 are undeformed and are stabilized using a non-tapered filler member 314 (FIG. 17). In similar concept and as shown in FIGS. 26 and 27, all three T-slots 242 in each of slotted rail section 104 and the slotted rail section 105 are configured to provide a maximum net 7½° ascending vertical curvature (2½° by 3 T-slots) and a net 7½° descending vertical curvature. The vertical inclination can be extended over non-slotted rail section 106 to provide a net elevation change to rail assembly 102, which is still greater than that shown in either of FIGS. 1 and 25. As is appreciated from the foregoing, the possibilities are endless for creating various elevation changes in a monorail track system by combining slotted rail sections providing various degrees of inclination and declination with non-slotted rail sections. More importantly, the slotted rail sections of the present invention are easily configured and reconfigured in the field using hand tools to provide virtually any desired track profile.

Many changes and modifications could be made to the invention without departing from the spirit thereof. The scope of these changes will become apparent from the appended claims.

I claim:

1. A method of forming a rail section with vertical curvature, the method comprising:

(A) providing a rail section having a major axis, the rail section including an upper portion, a lower portion, and a web extending at least generally vertically between the upper portion and the lower portion, wherein a slot is formed in the rail section and extends into the web from one of the upper and lower portions; and then (B) bending the rail section about the slot, thereby to effect curvature of the rail section about the major axis; and (C) positioning a tapered filler block in the slot having a shape which at least generally compliments the shape of at least a portion of the slot.

2. A method as defined in claim 1, wherein the slot comprises a first slot and the rail section has a second slot formed therein which is spaced longitudinally from the first slot, and the method further comprising bending the rail section about the second slot by applying a force to the rail section to deform the second slot and to effect an additional incremental vertical curvature of the rail section, and positioning a tapered filler block in the second slot having a shape which at least generally compliments the shape of the second slot.

3. A method as defined in claim 1, wherein the slot has a first component which extends generally in parallel with respect to the longitudinal axis and a second component which extends at least generally orthogonally with respect to the longitudinal axis, and wherein the bending step comprises bending the rail about the first component of the slot to deform the second component of the slot.

4. A method as defined in claim 1, wherein the slot is generally T-shaped when viewed laterally so as to have a substantially horizontal leg extending longitudinally along the web and a substantially vertical leg extending downwardly from the a center portion of the substantially horizontal leg and through the lower portion of the rail section.

5. A method as defined in claim 1, wherein the tapered filler block tapers outwardly from an upper end portion thereof towards a lower end portion thereof, and wherein the rail section is bent upwardly during the bending step so that the slot assumes a shape which compliments the taper of the tapered wedge.

6. A method as defined in claim 1, wherein the tapered filler block tapers inwardly from an upper end portion thereof towards a lower end portion thereof, and wherein the rail section is bent downwardly during the bending step so that the slot assumes a shape which compliments the taper of the tapered wedge.

7. A method as defined in claim 1, wherein the bending step comprises turning a cam into driving engagement with a surface of the rail section.

8. A method as defined in claim 1, wherein the rail section is elastically deformed from an initial configuration to a final configuration during the bending step, and further comprising permitting the rail section to return to the initial configuration after the bending step.

9. A rail assembly comprising:

(A) at least one rail section having a major axis, the rail section having (1) an upper portion, (2) a lower portion, and (3) a web extending at least generally vertically between the upper portion and the lower portion, and wherein a slot is formed in the rail section that extends into the web from one of the upper and lower portions and has a portion which extends generally vertically; and (B) a filler block at least a portion of which is disposed within the portion of the slot and which, when viewed laterally, has a shape which substantially matches the shape of the portion of the slot.

10. A rail section as defined in claim 9, wherein the portion of the slot is tapered by bending the rail section to effect an incremental vertical curvature of the rail section, and wherein the portion of the filler block, when viewed laterally has a taper which substantially matches the taper of the portion of the slot.

11. A rail assembly as defined in claim 9, wherein the slot comprises a first slot and the rail section has a second slot formed therein which is spaced longitudinally from the first slot, wherein at least a portion of the second slot extends generally vertically and is tapered by additional bending of the rail section to effect an additional incremental vertical curvature of the rail section, and further comprising a second filler block at least a portion of which is disposed within the portion of the second slot, the portion of the second filler block, when viewed laterally having a taper which substantially matches a taper of the portion of the second slot.

12. A rail assembly as defined in claim 11, wherein the rail section has a third slot formed therein which is spaced longitudinally from the first and second slots, wherein at least a portion of the third slot extends generally vertically and is not tapered when viewed in transverse cross section, and further comprising a third filler block at least a portion of which is disposed within the portion of the third slot, the portion of the third filler block being substantially rectangular when viewed laterally.

13. A rail assembly as defined in claim 9, wherein the slot is generally T-shaped and has a tapered generally vertical leg forming the portion of the slot.

14. A rail assembly as defined in claim 9, wherein the slot and the filler block wedge both taper outwardly from an upper end portion thereof towards a lower end portion thereof to effect an incremental upward curvature in the rail section.

15. A rail assembly as defined in claim 9, wherein the slot and the filler block both taper inwardly from an upper end portion thereof towards a lower end portion thereof to effect an incremental downward curvature in the rail section.

16. A rail assembly as defined in claim 9, further comprising first and second cam bolts extending through first and second elongated apertures formed in the web at locations on opposite longitudinal sides of the slot, each of the first and second cam bolts including a cam which bears against side surfaces of the corresponding elongated aperture.

17. A rail assembly as defined in claim 16, further comprising third and fourth cam bolts extending through third and fourth elongated apertures formed in the web at locations on opposite longitudinal sides of the slot, each of the third and fourth cam bolts including a cam which bears against side surfaces of the corresponding elongated aperture, and wherein the cams of the first and second cam bolts are eccentric and the cams of the third and fourth cam bolts are concentric.

18. A rail assembly as defined in claim 16, further comprising a tie bar which extends longitudinally across and beyond the portion of the slot at a location laterally adjacent a first lateral side of the web and through which the first and second cam bolts extend, wherein the filler block is bolted to the tie bar by at least one connecting bolt.

19. A rail assembly as defined in claim 18, further comprising a keeper plate which extends longitudinally across and beyond the portion of the slot at a location laterally adjacent a second lateral side of the web, and wherein the connecting bolt extends through and bears against the keeper plate.

20. A rail assembly as defined in claim 9, wherein the rail section is a monorail section which is generally I-shaped when viewed in transverse cross section, and wherein the upper portion of the rail section forms an upper flange and the lower portion of the rail section forms a lower flange.

21. A rail assembly as defined in claim 20, wherein the slot extends substantially vertically from the lower flange, and wherein the filler block is in substantially the shape of an inverted T when viewed in transverse cross section so as to form a substantially contiguous surface with the lower flange and the web.

22. A rail section having a major axis, the rail section comprising:

A) an upper portion,

B) a lower portion,

C) a web extending at least generally vertically between the upper portion and the lower portion, D) a slot formed in the rail section, the slot having:

1) a vertical portion extending into the web from one of the upper and lower portions, and 2) a horizontal portion formed in the web adjacent the other of the one upper and lower portion.

23. A rail assembly comprising:

(A) first, second, and third interconnected rail sections, the second rail section being flanked by the first and third rail sections, each of the rail sections having a longitudinal axis and having (1) an upper portion, (2) a lower portion, and (3) a web extending at least generally vertically between the upper portion and the lower portion, wherein a plurality of slots are formed in the first rail section and extend into the web from one of the upper and lower portions, wherein at least a portion of the plurality of slots extends generally vertically into the web and the portion being tapered by bending of the first rail section to effect an incremental vertical curvature of the first rail section; and (B) a plurality of a filler blocks which are positioned in the slots and each of which, when viewed laterally, has a shape which compliments the shape of the corresponding slot.

24. A rail assembly as defined in claim 22, wherein an end of the first rail section located opposite the second rail section extends horizontally, wherein the second rail section is straight and extends at an acute angle with respect to the horizontal, and wherein an additional plurality of slots are formed in the third rail section and extend into the web from one of the upper and lower portions, wherein at least a portion of at least one of the additional plurality of slots extends generally vertically and is tapered by bending the rail section to effect an incremental vertical curvature of the third rail section, wherein the taper of the portion of the one additional slot extends opposite the taper of the portion of the one slot, and wherein an end of the third rail section located opposite the second rail section extends horizontally; and further comprising an additional plurality of a filler blocks which are positioned in the additional plurality of slots and each of which, when viewed laterally, has a shape which compliments the shape of the corresponding additional slot.

25. A monorail track assembly comprising:

(A) a plurality of interconnected rail sections each 1) having a longitudinal axis, 2) being generally I-shaped when viewed in transverse cross-section, and 3) having (1) an upper flange, (2) a lower flange, and (3) a web extending at least generally vertically between the upper flange and the lower flange, wherein a plurality of longitudinally-spaced slots are formed in at least one of the rail sections, each of the slots being substantially T-shaped when viewed laterally so as to have a substantially horizontal leg extending longitudinally along the web of the corresponding rail section and a substantially vertical leg extending downwardly from a center portion of the substantially horizontal leg and through the lower flange of the corresponding rail section, and wherein, when viewed in transverse cross section, at least the substantially vertical leg of at least one of the slots is tapered by bending of the corresponding rail section to effect an incremental vertical curvature of the corresponding rail section; and (B) a plurality of filler block assemblies, each of which is associated with a corresponding one of the slots, each of the filler block assemblies including (1) a filler block which is positioned in the substantially vertical leg of the corresponding slot, the filler block being substantially in the shape of an inverted T when viewed in transverse crosssection and having a transverse cross-sectional shape which complements the transverse cross-sectional shape of the corresponding slot so as to form a substantially contiguous surface with the lower flange and the web, the filler block having a lateral profile complimenting a lateral profile of the corresponding slot;

(2) a tie bar which extends longitudinally across and beyond the corresponding slot at a location laterally adjacent a first lateral side of the web of the corresponding rail section and to which the filler block is bolted by first and second vertically-spaced connecting bolts, (3) a keeper plate which extends longitudinally across and beyond the slot at a location laterally adjacent a second lateral side of the web of the corresponding rail section and against which the first and second connecting bolts bear, (4) first and second cam bolts extending through first and second vertically-elongated apertures formed in the web of the corresponding rail section and through the tie bar at locations on opposite longitudinal sides of the corresponding slot, each of the first and second cam bolts including an eccentric cam which bears against side surfaces of the corresponding vertically-elongated aperture, and (5) third and fourth cam bolts extending through first and second longitudinally-elongated apertures formed in the web of the corresponding rail section and through the tie bar at locations on opposite longitudinal sides of the corresponding slot, each of the third and fourth cam bolts including a concentric cam which bears against side surfaces of the corresponding longitudinally-elongated aperture.

* * * * *